United States Patent [19]

Mahruki

[11] Patent Number: 4,768,529

[45] Date of Patent: Sep. 6, 1988

[54] DEVICE FOR THE APPLICATION OF FLUIDS

[76] Inventor: Nimetullah Mahruki, Ortakoy Palanga Caddesi #15, Istanbul, Turkey, 80840

[21] Appl. No.: 893,918

[22] Filed: Aug. 7, 1986

[51] Int. Cl.[4] ..... A45D 40/00

[52] U.S. Cl. ..... 132/79 A; 401/116

[58] Field of Search ..... 132/88.7, 1 R, 74.5, 132/75, 79 A, 79 B, 79 C; 401/116, 118, 119, 100, 101, 151

[56] References Cited

U.S. PATENT DOCUMENTS

| | | | |
|---|---|---|---|
| 2,611,915 | 9/1952 | Prokop et al. | 401/116 |
| 2,872,694 | 2/1959 | Hopkins | 401/151 |
| 2,945,252 | 7/1960 | Martineau, Jr. | 401/116 |
| 2,978,723 | 4/1961 | Hopkins | 401/100 |
| 2,996,749 | 8/1961 | Hester | 132/79 A |
| 3,015,836 | 1/1962 | Maynier et al. | 132/1 R |
| 3,144,676 | 8/1964 | Mura | 401/151 |
| 3,159,863 | 12/1964 | Mura | 401/151 |
| 4,063,829 | 12/1977 | La Mura | 401/101 |

FOREIGN PATENT DOCUMENTS

| | | | |
|---|---|---|---|
| 824991 | 11/1951 | Fed. Rep. of Germany | 401/100 |
| 1153640 | 10/1957 | France | 401/100 |
| 1171175 | 4/1958 | France | 401/100 |

*Primary Examiner*—Robert Peshock
*Assistant Examiner*—J. Hakomaki
*Attorney, Agent, or Firm*—Evelyn M. Sommer

[57] ABSTRACT

A cylindrical chamber is provided having a funnel-shaped opening for introduction of fluid to be applied. The opening functions as a port through which a brush fluid applicator, can be moved from the inside to the outside of the chamber. The fluid applicator is mounted on an advance mechanism which includes a spindle having a threaded portion adapted to engage a rotating casing which has inside threads. Movement is effected by rotating a handle associated with the casing. When the applicator is outside of the chamber, the chamber opening is sealed by a conically shaped end of the advance mechanism, which is engaged by the chamber opening. The conically shaped end has tiny channels thereon which allows a measured discharge of fluid when manual pressure is exerted on the upper chamber wall.

15 Claims, 2 Drawing Sheets

DEVICE FOR THE APPLICATION OF FLUIDS

BACKGROUND OF THE INVENTION

The present invention relates generally to a fluid applicator and, more particularly, to such an applicator which is particularly adapted to be used for the application of cosmetic preparations.

The application of the present invention includes a chamber, which is open on one end for fluid intake, and a longitudinal advance mechanism located within the chamber. The advance mechanism has a fluid applicator located at its end, which, upon longitudinal movement of the advance mechanism by way of gear works activated from outside the chamber, can be moved in and out of the open end of the chamber. The chamber, which can be sealed at its open end by a removeable cap, further includes a chamber base with rotating gearworks located therein for the longitudinal movement of the advance mechanism. The gearworks are activated by a handle which rotates around the axis of the chamber base. Disposed between the components which rotate relative to one another are an arrangement of seals.

Fluid applying devices of the type disclosed in the instant case have a wide variety of uses. In particular, such devices have been used in the cosmetics industry. Fluids which have been applied by using such devices have included thick cosmetics such as nail polish, lipstick, mascara, eye makeup and liquid rouge. Such devices have also been used for the application of pharmaceutical and other related products.

The fluid applicator may include a brush, crayon or small comb for the application of a fluid which is stored within the chamber. The fluid is generally applied to areas which include fingernails, eyelashes, lips, eyebrows and other parts of the skin.

The use of such applicators are advantageous in that they permit the user to accentuate the natural contour of those aforementioned areas, since such an applicator permits the user to precisely draw tiny lines or outlines around the selected area.

The invention further includes a device for the application of fluids. In such a device, an advance mechanism, preferably a brush, is submerged in the fluid when it is retracted into the chamber and is so to speak cleansed therein.

In addition, the invention includes a device to provide for the application of fluids in which the fluid contains a solution of volatile solvents such as, for example, acetone and dissolved substances which can be used without detriment. For instance, when the surface of the fluid advance mechanism is exposed to air in its position of use, the mechanism becomes covered or filled with a film of the evaporated solvent. This film should dissolve automatically again and, thereafter, the fluid advance mechanism is rinsed and cleansed when the advance mechanism is brought into the retracted or submerged position. The advance mechanism is thereby immediately ready for the next application.

Thus, following each employment of the fluid present on the advance mechanism, the mechanism need not be reintroduced into the chamber for the purpose of receiving additional fluid. Instead, the pressure exerted on the flexible chamber wall by the fingers of the user brings about a continuous supply of fluid to the advance mechanism.

Finally, the device should make it possible to automatically provide an exact amount of the quantity supplied to the advance mechanism for application of slightly creamy cosmetics such as mascara and other products. Because of the unique construction of the chamber and advance mechanism, excess cream is withheld or wiped off when the mechanism is advanced.

Against the foregoing background, it is thus a primary object of the present invention to provide a device for applying fluids which permits communication of the fluid with the applicating mechanism without having to reintroduce the mechanism into a chamber which holds the fluid.

It is another object of the present invention to provide such a device which automatically provides an exact amount of fluid to the applicating mechanism.

It is still another object of the present invention to provide such a device having a construction which causes the solvent gas, typically contained within the fluid, to remain within the chamber, thereby prolonging the useful life of the fluid.

SUMMARY OF THE INVENTION

To the accomplishments of the foregoing objects and advantages, the present invention, in brief summary, comprises a chamber for containing a fluid. The chamber has an opening at one end for the introduction of the fluid and a base at an opposing end.

An advance mechanism is disposed within the chamber. The advance mechanism is adapted to move longitudinally within the chamber. Applicating means are disposed on an end of the advance mechanism. The applicating means are adapted to pass beyond the chamber through the opening as the advance mechanism is longitudinally moved in the direction of the opening. A cap is used to seal the opening when the applicating means is within the chamber.

Rotating means are disposed within the base. The rotating means are associated with the advance mechanism such that upon rotation of the rotating means longitudinal movement of the advance mechanism is effected. Also provided are means for actuating the rotating means. A barrier is associated with the actuating means and the base, so that the solvent gas present in the liquid is prevented from passing beyond the barrier.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 1:
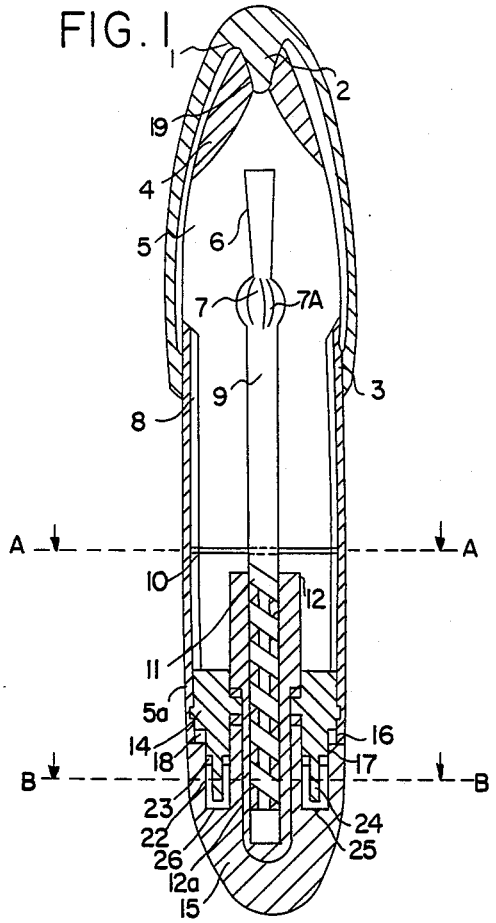
FIG. 1 is a longitudinal sectional view of the instant device when the applicator is not deployed.
Figure 2:
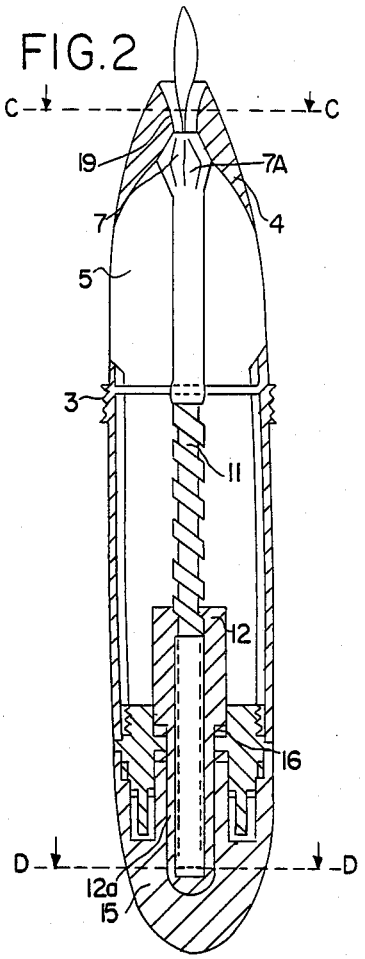
FIG. 2 is a longitudinal sectional view of the instant device when the applicator is in the position of deployment and with the cap removed.

Referring to the drawings and, in particular FIGS. 1 and 2 thereof, where like parts are represented by like reference numerals, the application device of the present invention is illustrated. The instant device includes a substantially cylindrical chamber 5 preferably fabricated from a suitable material such as a variety of synthetic materials. Such synthetic materials can include, for example, rubber, metal or similar materials. Chamber 5 includes an anterior portion 4 which varies in thickness with respect to the wall of chamber 5, so as to create a funnel-shaped opening 19. A locking cap 1 is provided to seal opening 19 thereon. The seal is completed by insertion of projection 2, contained on locking cap 1, into opening 19. Locking cap 1 can be manually screwed onto chamber 5 by way of engagement between thread 3 and grooves (not shown), which are interiorly disposed on cap 1.

Figure 3:
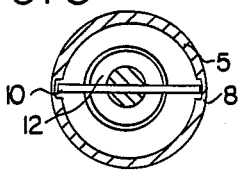
FIG. 3 is a cross-sectional view taken along line A—A of FIG. 1.

Referring to FIGS. 1–3, also shown is fluid applicator brush 6. Although the fluid applicator is illustrated as a brush, it is to be understood that other applicators may be used, such as a crayon or a small comb. Brush applicator 6 is disposed on end portion 7 of rod-shaped advance mechanism 9. In a preferred embodiment, the end of advance mechanism 9 which opposes end portion 7 includes a threaded spindle 11 to permit longitudinal adjustment of advance mechanism 9 which can be longitudinally adjusted by rotating casing 12, which engages threaded spindle 11 in meshing relation. As such, when casing 12 is rotated the engagement with spindle 11 allows mechanism 9 to move back and forth longitudinally. Casing 12 is prevented from rotating independently of mechanism 9 by pin 10, which extends across and through mechanism 9, running within a longitudinal guideway 8 along the side of chamber 5.

Casing 12 includes an end portion 12*a*, which is smaller in diameter and, which extends through the chamber base 14 into a handle 15, which is rotatably mounted to chamber 5. Manual rotation of handle 15 causes rotation of threaded casing 12, which, in the manner heretofor described, causes longitudinal movement of mechanism 9.

Figure 5:
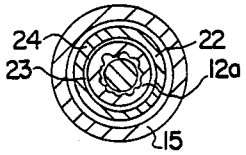
FIG. 5 is a cross-sectional view taken along line B—B of FIG. 1.
Figure 6:
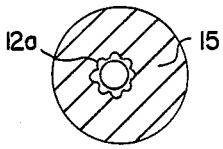
FIG. 6 is a cross-sectional view taken along line D—D of FIG. 2.

Referring in particular to FIG. 5 it can be seen that end portion 12A includes a plurality of prongs about it's circumference and is secured to handle 15 to prevent rotation.

Referring again to FIGS. 1 and 2, it will be seen that chamber base 14 is secured to the chamber 5 at point 5*a*. The securing can be accomplished by any suitable means, preferably by either gluing or welding. The casing 12 is adapted to rotate within the chamber base 14. Since threaded casing 12, end portion 12A and chamber base 14 are adapted to rotate relative to one another, the potential exists for the leakage of fluid between these parts. To prevent such leakage, seals 16, 17 and 18 are disposed between these parts. Although these seals may be fabricated from a wide variety of commercially acceptable materials, in a preferred embodiment, the seals can be fabricated from rubber or a similar material.

As casing 12 is rotated by manually turning handle 15, mechanism 9 is moved in an outward direction as illustrated in FIG. 2 and end portion 7 moves into the funnel-shaped opening 19 at the end of chamber 5. The end portion 7 is conically constructed so that it can mesh with funnel-shaped opening 19 as seen in FIG. 2. In the protracted position, the end portion 7 of advance mechanism 9 makes contact with the inside of proximate convergent opening 19, and registers in opening 19 at least point-by-point along it's circumference so that between the contact points, apertures 7A for the passage of fluid to be supplied are defined, permitting delivery of a measured supply of fluid to the brush.

Depending on the fluid employed, the size of the inside crosscut of these apertures 7A for fluid passage are measured differently and are adjusted to the viscosity of the particular fluid in the chamber. The shape of the passage aperture 7A can be such that the end portion 7 of advance mechanism 9 has radial projections arranged about it's circumference which come up against a smooth bore funnel-shaped chamber interior to receive the fluid. In this manner, point-by-point contact occurs and there is sufficient clearance for the fluid to pass.

Figure 4:
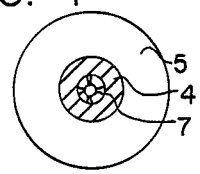
FIG. 4 is a cross-sectional view taken along line C—C of FIG. 2.

In a modified version, the apertures may take the form of channels which run in an axial direction around the circumference, can be constructed with the conical end portion 7 in such a way that between these channels, the end portion 7 comes along linearly-shaped contact zones against the smooth bore funnel-shaped inside chamber wall to receive the fluid. Such a shape is shown in FIG. 4. Conversely, the channels arranged axially can also be constructed along the inside chamber wall in the area of the funnel-shaped opening 19 in which case the end portion 7 is then conical.

The brush 6 moves out of the position illustrated in FIG. 2 and back into the chamber 5, by the turning of the handle 15 in a counterclockwise direction. It is then submerged into the fluid contained therein. When the chamber which is closed by cap 1 is, for example carried in a handbag, the fluid is caused to move. As initially mentioned, this has a cleansing effect on the applicator brush 6. As the applicator brush 6 moves out of the position illustrated in FIG. 2, excess fluid is removed. Were this not the case, the exact application of the limited amount of fluid to be applied would be compromised, i.e., the drawing of exact sharp lines or outlines would be frustrated. The fluid is wiped off by the opening 19 that has been appropriately measured for this purpose. As stated previously, it is to be understood that other forms of applicator 6 may be used e.g., a pencil which picks up the fluid, etc.

Figure 7:
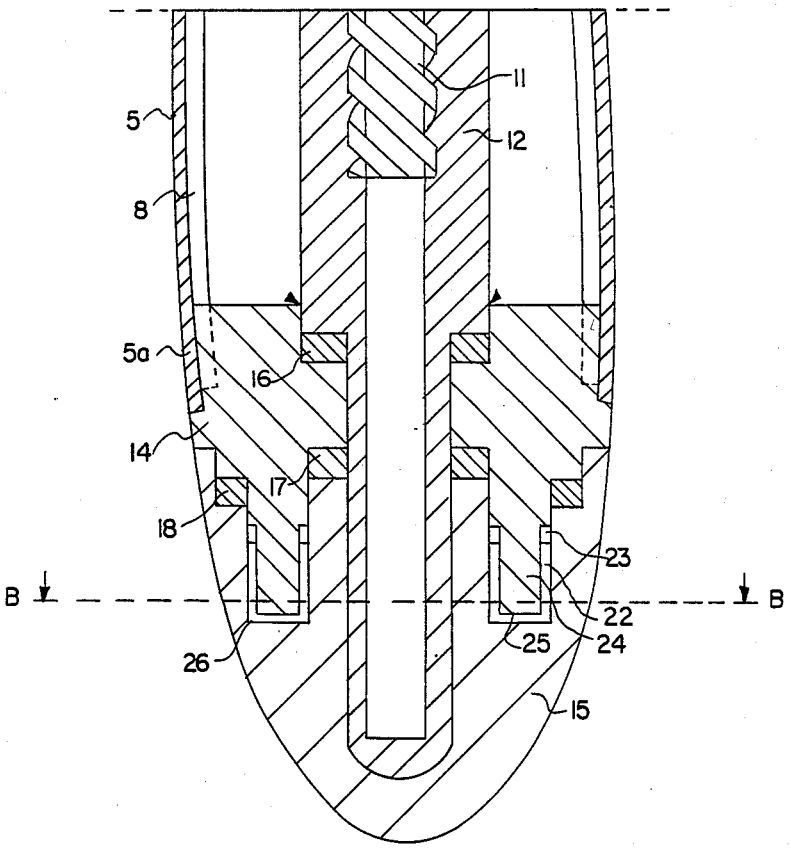
FIG. 7 is a cutaway view which shows an enlarged view of the under side of the instant device.
Figure 8:
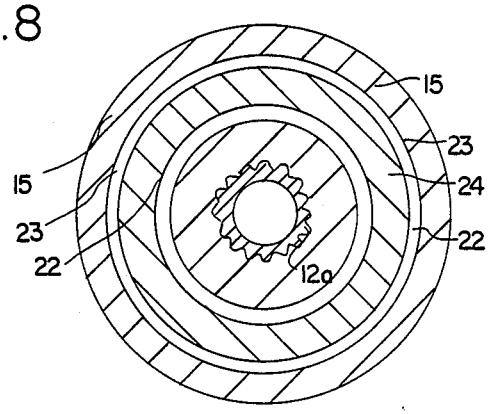
FIG. 8 is a cross-sectional view taken along line B—B of FIG. 7.

Referring to FIGS. 1, 2, and 7, seals 16, 17, and 18 are provided which, under normal temperature conditions prevent the escape of solvent gas from the chamber. Many cosmetics contain such volatile solvents as acetone or butylacetate. At higher temperatures in tropical countries, rather high pressures of the gas results from the easily volatile solvent gases inside the cap-sealed chamber, thereby permitting its solvent gases to escape through the seals 16, 17, or 18 in significant quantities. As a result, the fluid contained in the chamber, such as nail polish, would be caused to thicken. In order to prevent the escape of solvent gases and resultant thickening of the fluid, an annular clearance shaped space 25 is provided between the parts turning relative to each other and sealed off from one another by the seals 16, 17 or 18. The space 25 is a receptacle for fluid which either serves as a gaseous barrier to prevent the escape of the gaseous phase of the fluid in chamber 5, or as a reservoir for the subsequent supply of solvent. This solvent is filled into the annular-clearance-shaped space and is the same as the solvent contained in the chamber, so that the solvent is supplemented.

In the preferred form of the device represented in FIGS. 1–8, the annular-clearance-shaped space 25 is, in cross section, a U-shaped annulus having one vertical internal shank 22 and one external shank 23. This U-shaped annulus 25 is located between the chamber base 14 and the handle 15, which is connected to the chamber base 14 and, which is designed as a turnable grip. The annulus 25 is formed by a circular nut 26 drilled inside the handle 15 and by a cylindrical projection 24 on the underside of the chamber base 14 which extends into this nut. Between the projection and the nut a space exists, creating a U-shaped annulus 25. This annulus is filled with fluid. When the solvent gases contained in the chamber attempt to escape, they travel along the path indicated by arrows in FIG. 7, between the parts 12, 14 and 15 rotating relative to each other, and pass the seals 16 and 17. The solvent gases then hit the fluid in the U-shaped annulus 25 and cannot pass by it. Inside this space is a special fluid, which in chemical and physical terms, is completely inert the nail polish gases. Owing to it's viscosity, this special fluid also cannot escape through the outer seal 18. At most, a gas pressure thus occurs along the internal flank 22 of the U-shaped annulus filled with fluid. But no gas is permitted to escape and, as a result, the nail polish will not dry out.

In one variation of use, the same solvent mixture that is also present in the nail polish in chamber 5 is filled into the U-shaped annulus 25. In this model, which is not illustrated, the seal 17 located inside is arranged outside under seal 18 in such a way that the path of the solvent gases to the outside is blocked by two back-to-back seals. The inside seal 16 is, in this case, a semipermeable seal, permeable in one direction so that the solvent from the annulus 25, that is U-shaped in cross section, can move into the inside of chamber 5 to supplant the solvent escaping therefrom. Thus, the solvent reservoir inside the annulus 25 facilitates subsequent solvent supply. In this manner, the solvent lost in gaseous form from the top of the chamber during employment of the device is continuously replaced until all of the solvent present in the solvent reservoir is used up. The ratio between the amount of nail polish in the chamber and of the solvent in the reservoir, as well as the volumes required for the reservoir, can be determined in advance in such a way that the solvent, including the amount supplemented from the reservoir, suffices for the consumption of the nail polish.

Having thus described the invention with particular reference to the preferred forms thereof, it will be obvious that various changes and modifications may be made therein without departing from the spirit and scope of the invention as defined by the appended claims.

What is claimed is:

1. A device for the application of a fluid having a solvent gas, said apparatus comprising:

a chamber for containing said fluid, said chamber having at one end an opening for applying said fluid and having at the opposing end a base;

an advance mechanism disposed within said chamber, and adapted to move longitudinally within said chamber;

applicating means disposed at one end of said advance mechanism, and adapted to move through said opening past said chamber as said advance mechanism is longitudinally moved in the direction of said opening;

a cap for sealing said opening;

rotating means disposed within said base, and associated with said advance mechanism so that upon turning of said rotating means longitudinal movement of said advance mechanism is effected;

actuating means located adjacent said base and outside said chamber for actuating said rotating means; and a barrier defined by an annular space between said actuating means and said base to prevent the solvent gas in said fluid from passing from said base into said actuating means and thus out of said chamber.

2. The device of claim 1, wherein said barrier is an annulus which is U-shaped in cross section.

3. The device of claim 1, wherein said barrier is associated with said actuating means and said base by a circular nut drilled into said actuating means and a cylindrical tubular projection which extends into said nut on the underside of said base.

4. The device of claim 1, which further comprises a plurality of seals disposed between said barrier, said rotating means, said base and said actuating means.

5. The device of claim 4, wherein said seals are semipermeable.

6. The device of claim 1, wherein the end of said advance mechanism proximate said applicating means is substantially conical.

7. The device of claim 6, wherein said substantially conical end makes point-by-point contact with the circumference of said open end of said chamber when said applicating means passes beyond said chamber through said opening.

8. The device of claim 7, wherein areas are formed between said points of contact, such that said areas define apertures for the passage of fluid to be applied.

9. The device of claim 8, wherein the size of said aperture for fluid passage corresponds directly to the viscosity level of said fluid.

10. The device of claim 9, wherein said apertures comprise radial projections distributed around the circumference of said conical end of said advance mechanism.

11. The device of claim 1, wherein said rotating means comprises a threaded spindle disposed on an end opposite said applicating means, said spindle adapted to interact with a rotating threaded casing which surrounds said threaded spindle and which is disposed within said chamber.

12. The device of claim 11, wherein said threaded casing is adapted to be rotated by said actuating means.

13. The device of claim 1, wherein the portion of said chamber which contains said fluid is fabricated from a flexible material so that when pressure is exerted on the chamber by the fingers of a user a continuous flow of fluid is ensured.

14. The device of claim 2, wherein said annulus is a reservoir for holding an additional supply of solvent gas.

15. The device of claim 14, which further comprises a plurality of seals disposed between said barrier, said rotating means, said base and said actuating means, wherein at least one of said plurality of seals is semipermeable to permit the additional supply of solvent gas in the reservoir to flow into said chamber, while the remaining plurality of seals prevent the solvent gas present in said liquid from passing beyond said barrier out of said chamber.

* * * * *